US007712238B2

(12) United States Patent
Sender et al.

(10) Patent No.: US 7,712,238 B2
(45) Date of Patent: May 11, 2010

(54) CEILING MOUNTED DISPLAY SIGN

(75) Inventors: Edward Sender, 441 W. Rand Rd., Mount Prospect, IL (US) 60056; Harold Reed, Elk Grove Village, IL (US); Dave Carta, Chicago, IL (US)

(73) Assignee: Edward Sender, Mount Prospect, IL (US)

( * ) Notice: Subject to any disclaimer, the term of this patent is extended or adjusted under 35 U.S.C. 154(b) by 334 days.

(21) Appl. No.: 10/782,476

(22) Filed: Feb. 19, 2004

(65) Prior Publication Data

US 2005/0005490 A1 Jan. 13, 2005

Related U.S. Application Data

(60) Provisional application No. 60/448,507, filed on Feb. 19, 2003.

(51) Int. Cl.
*G09F 7/22* (2006.01)

(52) U.S. Cl. ..... 40/473; 40/493; 40/431; 40/430

(58) Field of Classification Search ..... 40/431, 40/434, 473, 617; 362/801, 404, 430; 248/342, 248/343, 323

See application file for complete search history.

(56) References Cited

U.S. PATENT DOCUMENTS

| | | | | | |
|---|---|---|---|---|---|
| 1,824,270 | A | * | 9/1931 | Holzman | 40/432 |
| 2,629,044 | A | * | 2/1953 | Marfisi | 40/431 |
| 3,031,784 | A | * | 5/1962 | Stein | 40/473 |
| 3,962,806 | A | * | 6/1976 | Eby | 40/473 |
| 4,041,657 | A | * | 8/1977 | Schuplin | 52/39 |
| 4,290,218 | A | | 9/1981 | Drueck, Jr. | 40/553 |
| 4,528,764 | A | | 7/1985 | Cobb | 40/553 |
| 4,947,750 | A | | 8/1990 | May et al. | 40/553 |
| 5,025,355 | A | | 6/1991 | Harwood | 40/553 |
| 5,044,103 | A | | 9/1991 | Izenberg | 40/617 |
| 5,128,850 | A | | 7/1992 | Juodvalkis | 362/352 |
| 5,274,938 | A | | 1/1994 | McDonald et al. | 40/617 |
| 5,282,331 | A | | 2/1994 | Fell | 40/617 |
| 5,355,604 | A | * | 10/1994 | Rathke | 40/601 |
| 5,367,808 | A | * | 11/1994 | Liebman et al. | 40/617 |
| 5,772,314 | A | | 6/1998 | Brumer | 362/360 |
| 6,397,531 | B1 | | 6/2002 | Martin | 40/617 |

(Continued)

FOREIGN PATENT DOCUMENTS

| | | | |
|---|---|---|---|
| FR | 2636222 | 3/1990 | 40/430 |

OTHER PUBLICATIONS

Two sketches allegedly presented by a third party to a potential customer in the late 1980's as part of an alleged offer for sale of a rotating sign prototype. The sketches allegedly show a solar powered rotating display sign suspended from a ceiling.

(Continued)

*Primary Examiner*—Cassandra Davis
(74) *Attorney, Agent, or Firm*—Greer, Burns & Crain, Ltd.

(57) ABSTRACT

A display sign includes a sign mount configured to engage support rails of a ceiling and a graphics display supported by the sign mount and configured for rotation about 360°. A motor may be provided to power rotation of the graphics display.

22 Claims, 3 Drawing Sheets

U.S. PATENT DOCUMENTS

| | | | | |
|---|---|---|---|---|
| 6,577,285 | B1 * | 6/2003 | Motonakano et al. | 345/10 |
| 6,758,654 | B2 * | 7/2004 | Liu | 416/146 R |
| 6,851,211 | B2 * | 2/2005 | Sender | 40/617 |
| 2003/0177680 | A1 | 9/2003 | Sender | |

OTHER PUBLICATIONS

"AMF Bowling Products Guide" Web Page published on the World Wide Web at http://www.iass.com/amflec.html believed published Circa 2001, showing "Ceiling Light Thief Display".

* cited by examiner

CEILING MOUNTED DISPLAY SIGN

CROSS REFERENCE

The present invention claims priority under 35 U.S.C. §119 on U.S. Provisional Patent Application No. 60/448,507 filed on Feb. 19, 2003.

FIELD OF THE INVENTION

The present invention is related to display signs, including display signs that are suspended from a ceiling.

BACKGROUND OF THE INVENTION

Signs for displaying information such as promotional information are generally known. In particular, one class of such signs comprises displays that may be suspended from a ceiling for displaying information such as point of purchase advertising or other information. Some signs may be adapted for suspension from a ceiling of the type that has a latticework of crossing members for holding ceiling tiles. Signs that are known in the art as "light thief" signs are so adapted, and may be suspended below a portion of the ceiling housing a light source, with the light from the source used to illuminate display panels of the sign.

The display panels may, for example, drop generally vertically or at an angle from the ceiling, so that they are visible to one looking from the floor towards that portion of the ceiling. A particular sign may comprise two or more display panels, with an example being a light thief sign that has four panels arranged about its periphery.

The lattice work used to support the ceiling tiles and display signs in such circumstances is generally in the form of a grid, with one set of lattice members, referred to herein as support rails, running along what may be though of as an X axis, and a second set running along what may be thought of as a perpendicular Y axis. The ceiling lattice thereby creates a grid with a plurality of substantially square or rectangular "grid cells" created between intersecting X and Y axis support rails. Each of these grid cells generally holds a square or rectangular ceiling tile, with an occasional cell having alight fixture such as a fluorescent ballasts and bulbs with a translucent panel. Generally, light thief signs are used to replace panels below a light fixture so as to be illuminated by the ceiling light source. Light thief signs can also be used to replace non-illuminated panels.

Display signs such as the described light thief displays as known are limited to placement depending on the lattice grid. That is, such display signs are generally limited to an orientation of display that is determined by the lattice ceiling grid orientation. By way of example, if a light thief display has four display panels oriented in a generally square manner, the panels will be displayed parallel to the X and Y axis of the ceiling lattice when the light thief is installed.

Often, this proves disadvantageous. For example, consider a store having a substantially square floor plan with a liquor department in one corner of the store. The main entry door to the store is at the opposite corner of the store. Further assume that a liquor vendor desires to use a light thief to display promotional advertisements using a light thief in the liquor department. Because the panels of the light thief run parallel to the ceiling lattice, however, the display panels are not oriented to the main entry to the store that is diagonal to the location of the liquor department. Disadvantageously, then, consumers entering the store may not be able to easily read or even see the display panels.

Recently, co-owned and currently pending U.S. application Ser. No. 10/103,388 has been proposed. While the teachings of this application meet some of the aforementioned needs, others are left unresolved.

SUMMARY OF THE INVENTION

The present invention is directed to display signs for mounting from a ceiling. One embodiment of the present invention includes a display sign for suspension from a ceiling of the type that has a plurality of support rails, the display sign comprising a sign mount configured for engaging a plurality of the ceiling support rails, and a graphics display supported by the sign mount and rotatable about 360°. The present invention thereby provides a display sign for mounting from a ceiling that may advantageously be rotated as desired.

DETAILED DESCRIPTION

Figure 1:
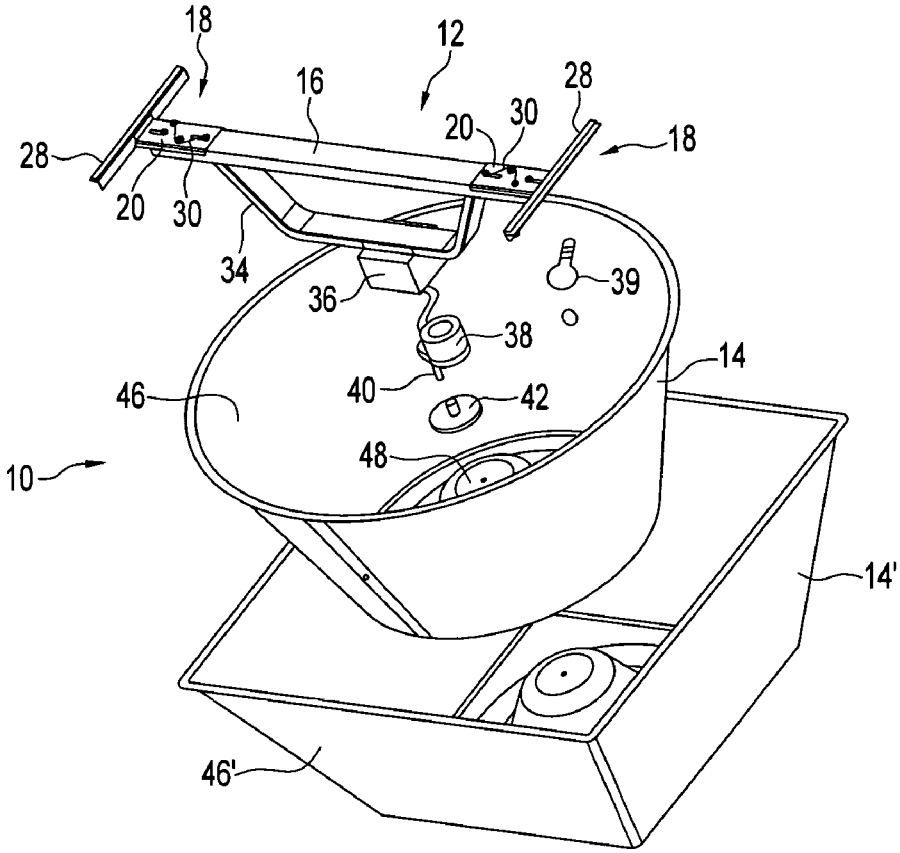
FIG. 1 is an exploded perspective view of one exemplary display sign embodiment of the invention shown with alternate exemplary graphics displays.
Figure 2:
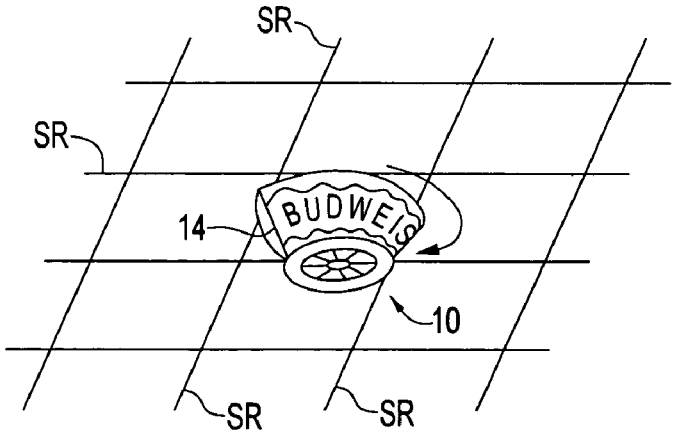
FIG. 2 is a perspective of an exemplary display sign of the invention installed on a ceiling.

Turning now to the drawings in order to best describe practice of the present invention, FIG. 1 is an exploded perspective view of an exemplary embodiment of a display sign 10 of the present invention. The sign 10 includes a sign mount shown generally at 12, and a graphics display 14 connected thereto. The graphics display 14 may be rotated about a full 360°. Different graphics displays are contemplated, with FIG. 1 illustrating a generally cylindrical shaped first display 14 and an alternate generally cube shaped display 14'. Other configurations are also contemplated. FIG. 2 is a perspective view of the display sign 10 installed on a ceiling, with the graphics display 14 rotatable about 360° as indicated by the arrow.

Figure 3:
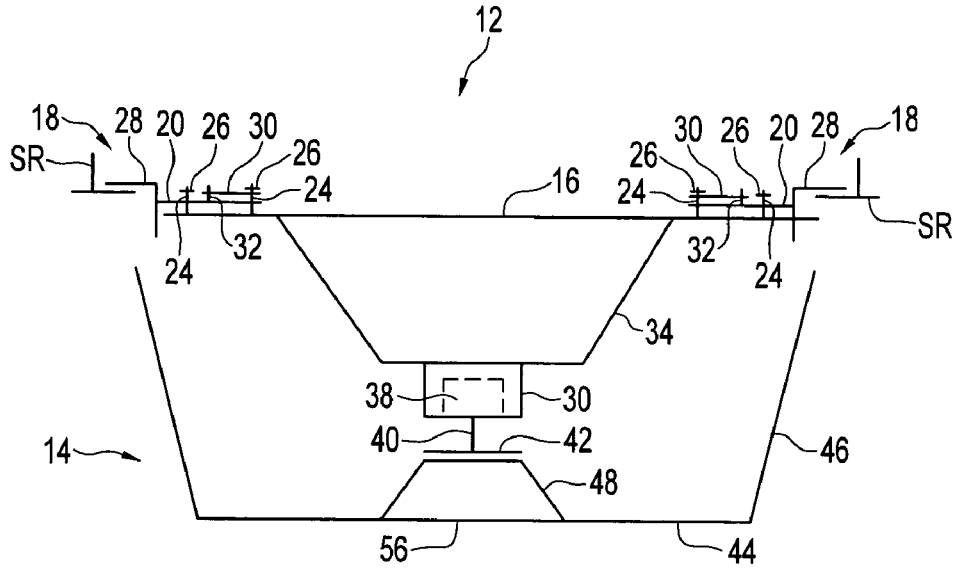
FIG. 3 is a schematic cross section of an exemplary display sign of the invention installed on a ceiling.

Referring now to FIGS. 1-3, the sign mount 12 includes a cross member 16 with a mounting bracket 18 at each end. The preferred cross member 16 comprises a cross rail having a generally inverted-U shape, a substantially flat top surface, and is made of aluminum or similar lightweight metal or plastic. This configuration offers a desirable combination of strength, weight, and fabrication advantages. The sign mount 12 supports all other underlying elements of the display sign 10. The mounting brackets 18 are configured to engage support rails of a ceiling grid, shown as element SR in FIG. 3 (and FIG. 2). It will be appreciated that the support rails SR are known in the art and generally have an inverted-T or an upright L shape for supporting the panels of a hanging ceiling. The support rails SR are not an element of the presently claimed invention, but are shown only for completeness of describing an environment in which the invention may be practiced.

One or both of the mounting brackets 18 are slidable along the cross rail 16. This allows for ease of installation, and also allows for the display sign 10 of the present invention to be supported between differently spaced support rails SR. Preferably, one or both of the mounting brackets are biased into engagement with the support rails SR.

Figure 4:
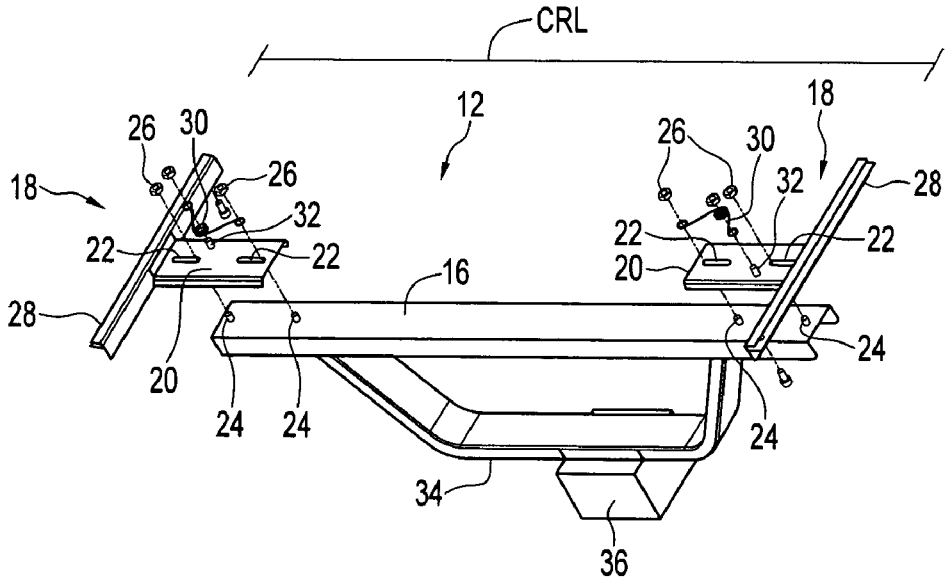
FIG. 4 is an exploded view of an exemplary sign mount of the invention.

The arrangement of the exemplary mounting bracket is best illustrated in the views of FIGS. 3-4. The mounting brackets 18 include a base 20 that slides along the cross rail 16. The base 20 may have side walls depending therefrom for engaging the sides of the inverted U shaped cross rail 16 as generally shown in FIGS. 1 and 4 for purposes of stability. Each base 20 has two slots 22 (FIG. 4) through which guide studs 24 extend from the cross rail 16. Preferably the studs 24 are threaded. A stud head 26, which is preferably a nut, is removably attached to each of the studs 24. In operation, the stud 24, stud head 26, and slot 22 cooperate to provide generally stable sliding motion in the direction along the length of the cross rail 16, and also limit the extent of travel. The stud heads 26 also prevent the mounting brackets from separating from the cross rail 16, and may be tightened to lock the mounting brackets in place at a desired position on the cross rail 16.

The exemplary mounting brackets 18 include an inverted L-shaped engagement member 28 configured to engage the ceiling support rails SR. It will be appreciated that the inverted L shape cooperates with the inverted T or upright L shape that is typical of support rails SR. The exemplary mounting brackets 18 further include a biasing means for biasing the engagement member 28 into engagement with the support rail SR. The preferred biasing means is a spring, with the illustrated spring clip 30 one particular type of spring that has been discovered to be useful. A spring anchor 32 is connected to the mounting bracket base 20 and holds one end of the spring clip 30. The spring anchor may be a threaded stud, with a nut provided as illustrated to hold the spring clip 30 in place. Likewise, the spring clip 30 is retained on the guide stud by the nut 26. An opposite end of the spring clip 30 is held by one of the guide studs 24 that extend through one of the slots 22.

Although the two mounting brackets 18 have been illustrated as being substantially identical to one another, it will be appreciated that use of different brackets is contemplated. For example, although both brackets 18 have been illustrated as being slidably adjustable along a portion of the length of the cross rail 16, for purposes of cost and simplicity of design, it may be desirable to fabricate the sign mount 12 with only one mounting bracket 18 being movable, and a second being immovably attached to the cross rail 16. Two movable brackets 18 may be desirable in order to center the cross rail 16 and its supported graphics display 14 between support rails SR.

Because the sign mount 12 and its cross member 16 support all of the under-hanging display sign 10, it is desirable that they be strong and firmly attached to the ceiling support rails SR. Also, because the display sign 10 may be suspended from a ceiling, it is desirable that they be relatively lightweight. The preferred sign mount 12 with its cross rail 16 and mounting brackets 18 are believe to meet these needs, particularly when made of relatively lightweight and strong materials, such as aluminum, rigid plastic, and the like.

As shown by FIGS. 1, and 3-4, a generally U shaped support arm 34 depends from the cross rail 16. A motor housing 36 is held on the support arm 34, with a motor 38 (FIG. 1, and shown in dashed in FIG. 3) contained therein. The motor 38 includes a rotating shaft 40. The motor 38 may be any suitable motor, with a lightweight motor such as a small toy AC or DC motor one example. Power to the motor 38 may be supplied through a traditional means such as connection to an AC power source, a DC battery, and the like. In addition or as an alternative to the motor 38, a light source may be provided. For example, a bulb illustrated as element 39 in FIG. 1 can be attached to be support arm 34 and to a power supply. This may be particularly desirable when using the display sign 10 in a position on a ceiling that is not below a ceiling light source.

It will be appreciated that although the exemplary display sign 10 has been illustrated with a motor 38, other invention embodiments do not include a motor. In some invention embodiments, manual rotation of the graphics display 14 can be utilized, and may be desirable for considerations of cost, weight, complexity, and the like. If no motor 38 is provided, the rotating shaft 40 may be directly and rotatably connected to the support arm 34. Bearings or other known means may be provided to aid rotation.

Figure 5:
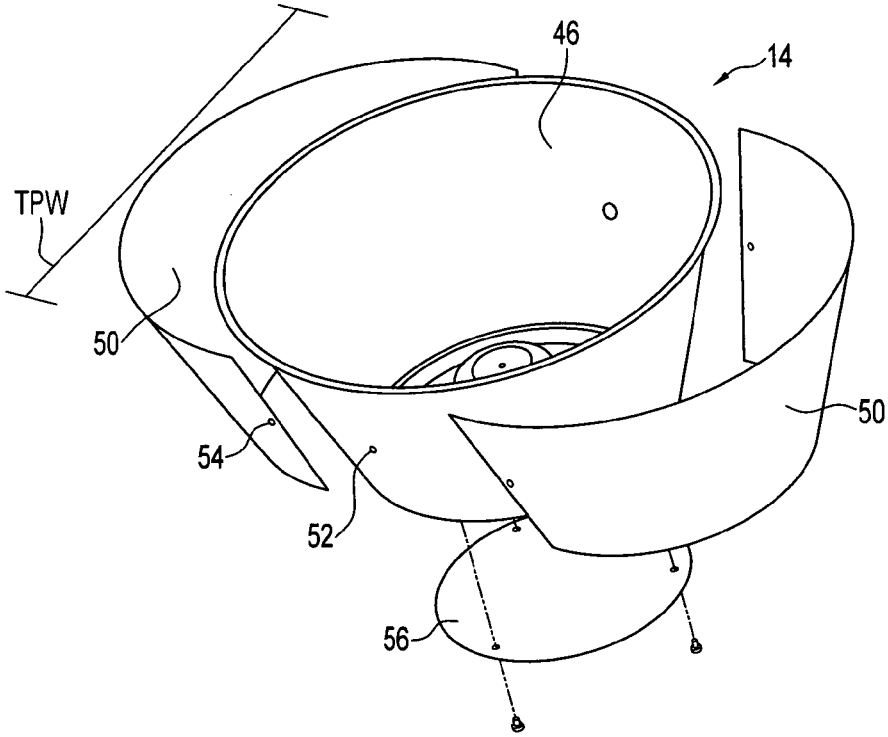
FIG. 5 is an exploded perspective of one exemplary graphics display of the invention; and, FIG. 6 is an exploded perspective of a second exemplary graphics display of the invention.
Figure 6:
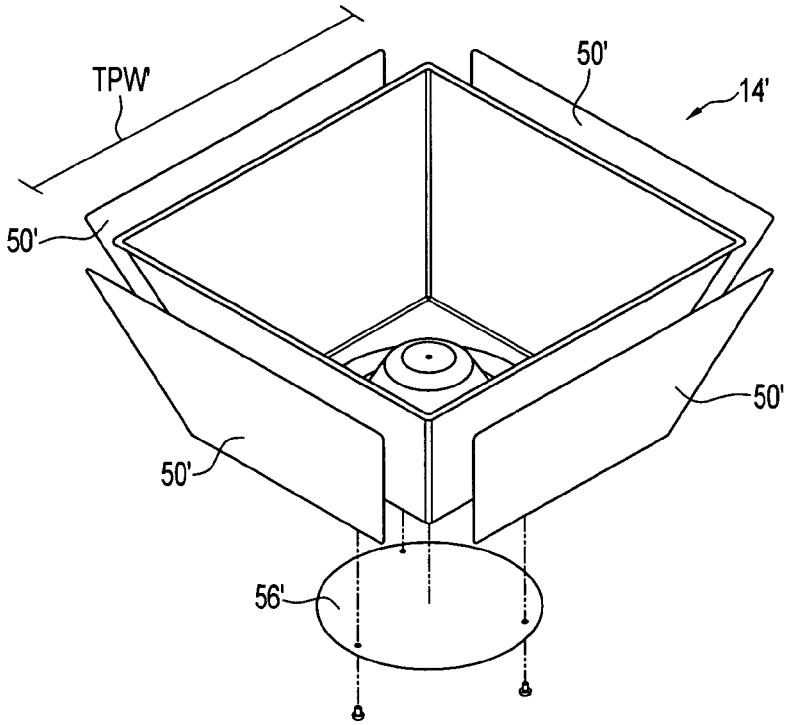

The graphics display 14 is linked to the rotating shaft 40. It is noted that as used herein the terms "link" and "linked" are intended to be broadly interpreted as connected, but not necessarily directly connected. For example, two elements may be "linked" to one another if they are not directly connected but are instead each directly connected to a third element that is intermediate to both of them. Preferably, a turntable 42 is provided that is attached by an adhesive or other means to the graphics display 14. FIG. 3 shows a schematic cross section of the graphics display 14, while FIGS. 5-6 show exploded perspective views of alternate graphics displays 14 and 14'. The graphics displays 14 and 14' generally include a bottom wall 44 and a sidewall 46. The graphics displays 14 and 14' preferably have a tapered shape from top to bottom to aid viewing of the sidewalls 50 from below. An internal raised portion 48 (48' of FIG. 6) is also preferably provided.

The graphics display 14 preferably includes an open top, so that light from a ceiling light fixture may enter it. Further, the graphics display 14 preferably has a top perimeter width (e.g., the diameter of a generally cylindrical graphics display, and the width of a generally square graphics display) shown as TPW in FIGS. 5-6 that is greater than the length of the cross rail 16 (including its mounting brackets 18) shown as CRL in FIG. 4, so that when installed on a ceiling the graphics display 14 covers the entire light source. Although other dimensions are possible, it has been discovered that a top perimeter width TPW of at least 20" is useful for many applications. A pleasing and functionally advantageous configuration results, in which generally the entire ceiling light source is covered and not visible, and in which all of the light radiating from the light source travels through the graphics display.

The preferred graphics display 14 is made of a translucent or clear material so that light from the ceiling light source may be transmitted therethrough. One exemplary suitable material of construction that offers desirable strength, weight, and light transmitting properties is plastic. A relatively thin sidewall 46 is preferred to provide low weight and good transmission of light. The sidewall should also have a thickness sufficient for sturdy use and handling. Although other dimensions will be useful, it is believed that a sidewall thickness for a plastic graphics display 14 of less than about 0.10" is believed to be useful.

The graphics display 14 may be provided with a desired promotional message thereon, or may use interchangeable display sheets 50 as has been generally illustrated in FIGS. 5-6. Attachment means such as a fastener tab 52 that cooperates with a passage 54 may be provided to attach the sheets 50 to the sidewalls 46. The sheets 50 may also be attached to the inside of the sidewalls 46. A cover plate 56 is provided for attachment to the exterior of the bottom wall 44 in the region underlying the raised portion 48. This provides for an aesthetically pleasing flat and continuous appearance. Signage may also be provided on the bottom wall 44 and cover plate 56.

The bottom wall 44 is preferably linked to the rotating shaft 40. In the exemplary display sign 10, the turntable 42 is attached to the graphics display interior raised portion 48 using an adhesive or other fastener. The turntable 42 is then connected to the rotating shaft 40 with a locking screw or other known means. Although the graphics display 14 could be directly connected to the shaft 40, use of a separate turntable 42 is believed to be advantageous. Such use allows for a relatively thin walled and lightweight graphics display 14 to be constructed, and a relatively sturdy turntable 42 later attached thereto using an adhesive. The raised portion 48 is also advantageous in that it allows for the graphics display 14 to be attached closer to a center of gravity of the graphics display 14 and with a shorter shaft 40 than if it were attached on a flat bottom wall. This adds to the stability of the graphics display 14. The configuration of the graphics display 14 with its raised portion 48 is also advantageous in that the graphics display may be conveniently manufactured in a relatively straight forward plastic manufacturing process.

The display sign of the present invention thereby provides many advantages and solves many otherwise unresolved problems of the prior art. For example, a lightweight and robust display sign is provided that allows for 360° rotation and efficient and relatively low cost manufacture and fabrication.

It will be appreciated that although an exemplary display sign 10 has been described and discussed herein, the sign 10 is exemplary only and that other invention embodiments are contemplated. Those knowledgeable in the art will appreciate that many equivalents and alternatives to the various elements shown are within the scope of the invention as claimed. For example, although two exemplary graphics displays 14 and 14' have been illustrated, it will be appreciated that a wide variety of graphics displays may be practiced with the invention.

What is claimed is:

1. A display sign for suspension from a ceiling of the type that has a plurality of support rails, the display sign comprising:

a sign mount configured to engage a plurality of the ceiling support rails;

a graphics display supported by said sign mount, said graphics display rotatable about 360° and having a bottom wall; and, a rotating shaft linked to said sign mount and to said graphics display bottom wall, wherein said sign mount includes a cross rail with opposing ends, a mounting bracket at each of said opposing ends, each said mounting bracket including a base connected to said cross rail and an engaging member connected to said base and oriented substantially perpendicularly to said base, said engaging member configured to engage at least one of the plurality of ceiling support rails, at least one of said mounting brackets being slidably adjustable along a portion of said cross rail.

2. A display sign as defined by claim 1 wherein said cross rail has a generally inverted U shape, and wherein said at least one slidably adjustable mounting bracket further includes side walls descending therefrom over at least a portion of said inverted U shaped cross rail, and wherein said engaging member is generally elongated and has a substantially inverted L shape.

3. A display sign for suspension from a ceiling of the type that has a plurality of support rails, the display sign comprising:

a sign mount configured to engage a plurality of the ceiling support rails and having a cross member configured to engage two opposing of the support rails;

a generally U shaped support arm descending from said cross member;

a graphics display supported by said sign mount and rotatable about 360°; and a rotating shaft linked to said graphics display and to said generally U shaped support arm, wherein said cross member has a pair of mounting brackets, at least one of said pair of mounting brackets slidably adjustable along at least a portion of said cross member, said at least one slidably adjustable mounting bracket having a base with at least one slot, said cross member having a guide stud extending through said at least one slot.

4. A display sign as defined by claim 3 wherein said at least one slidably adjustable mounting bracket base has a spring anchor, and further including a biasing spring connecting said spring anchor and said guide stud.

5. A display sign as defined by claim 3 wherein said guide stud has a removable head that prevents removal of said mounting bracket from said cross member.

6. A display sign as defined by claim 5 wherein said guide stud is threaded, wherein said removable head is a nut that may be tightened to lockingly engage said base.

7. A display sign as defined by claim 5 wherein said base has a pair of slots, and wherein said cross member has a pair of guide studs, one each of said guide studs cooperating with one each of said slots.

8. A display sign as defined by claim 3 and further including a motor for driving rotation of said graphics display, said motor mounted on said support arm.

9. A display sign for suspension from a ceiling of the type that has a plurality of support rails, the display sign comprising:

a sign mount configured to engage a plurality of the ceiling support rails;

a graphics display supported by said sign mount, said graphics display rotatable about 360° and having a bottom wall, a sidewall, and an open top, wherein said graphics display is generally tapered from top to bottom; and a rotating shaft linked to said sign mount and to said graphics display bottom wall.

10. A display sign as defined by claim 9 and further including a turntable directly connected to said shaft and directly connected to said graphics display bottom wall.

11. A display sign as defined by claim 9 wherein said graphics display is linked to said sign mount by a connection on said bottom wall, said connection thereby contained within said graphics display.

12. A display sign as defined by claim 9 wherein said graphics display includes fastener means for attaching one or more graphics sheets to said sidewall.

13. A display sign as defined by claim 9 and further including a light source contained within said graphics display.

14. A display sign for suspension from a ceiling of the type that has a plurality of support rails, the display sign comprising:

a sign mount configured to engage a plurality of the ceiling support rails having a cross member with a length; and, a graphics display supported by said sign mount, said graphics display rotatable about 360° and having an upper perimeter width that is greater than said cross member length, wherein said graphics display has a bottom wall with an interior raised portion and an exterior cover plate underlying said raised portion.

15. A display sign as defined by claim 14 wherein said sign mount includes a cross member having a pair of mounting brackets that are each configured to engage one of the ceiling support rails.

16. A display sign as defined by claim 15 wherein at least one of said mounting brackets is slidably adjustable on said cross member.

17. A display sign as defined by claim 14 and further including a turntable attached to said raised portion by an adhesive, a rotatable shaft linked to said sign mount and directly connected to said turntable.

18. A display sign as defined by claim 14 wherein said graphics display further includes a sidewall, and wherein said sidewall, said bottom wall, and said raised portion are integral with one another, and wherein said cover plate is removable from said graphics display.

19. A display sign for suspension from a ceiling of the type that has a plurality of support rails arranged in a grid, with a light source within a particular of the grids, the display sign comprising:

a cross rail having two mounting brackets on its ends, at least one of said mounting brackets being slidable in a direction away from the other of said mounting brackets, said at least one slidable mounting bracket having at least one slot, said cross rail having a guide stud extending through said at least one slot, said mounting bracket having a spring anchor, a spring extending between said guide stud and said spring anchor and operative to bias said mounting bracket in a direction away from the other of said two mounting brackets, each of said two mounting brackets having an engaging member for engaging parallel of the ceiling support rails that define the particular grid having a light source, said cross rail having a length;

a generally U-shaped support arm descending from said cross rail;

a rotating shaft linked to said support arm; and a graphics display linked to said shaft, said graphics display having a bottom wall, a side wall, and a top that is at least partially open to allow light from the light source to enter, said graphics display linked to said shaft by a connection on said graphics display bottom wall, said graphics display having a top perimeter with a width greater than said cross rail length, said graphics display made of a substantially translucent material and able to be rotated 360°.

20. A display sign for suspension from a ceiling of the type that has a plurality of support rails, the display sign comprising:

a sign mount configured to engage a plurality of the ceiling support rails having a cross member with a pair of mounting brackets configured to engage one of the ceiling support rails, at least one of said mounting brackets slidably adjustable on said cross member, and having a biasing means operative to bias said at least one of said mounting brackets towards one of the support rails; and, a graphics display supported by said sign mount, said graphics display rotatable about 360°.

21. A display sign as defined by claim 20 wherein said biasing means comprises a spring.

22. A display sign as defined by claim 20 and further including a motor supported by said sign mount for rotating said graphics display.

* * * * *